US011535962B2

(12) United States Patent
McCaffrey

(10) Patent No.: US 11,535,962 B2
(45) Date of Patent: Dec. 27, 2022

(54) WEAVING ASSEMBLY AND METHOD OF USING

(71) Applicant: Raytheon Technologies Corporation, Farmington, CT (US)

(72) Inventor: Michael G. McCaffrey, Windsor, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/880,341

(22) Filed: May 21, 2020

(65) Prior Publication Data

US 2021/0363674 A1 Nov. 25, 2021

(51) Int. Cl.
*D03D 41/00* (2006.01)
*D03D 25/00* (2006.01)

(52) U.S. Cl.
CPC ..... *D03D 41/004* (2013.01); *D03D 25/005* (2013.01)

(58) Field of Classification Search
CPC ..... D03D 41/004; D03D 25/005
See application file for complete search history.

(56) References Cited

U.S. PATENT DOCUMENTS 3,556,165 A * 1/1971 Jisa ..... D03D 13/004 66/190
3,565,121 A * 2/1971 Svaty ..... D03D 47/00 139/453
3,584,658 A * 6/1971 Ferreirinha ..... D03D 37/00 139/16
3,620,261 A * 11/1971 Bulcock ..... D06C 3/00 139/295
3,672,404 A * 6/1972 Strauss ..... D03D 47/261 139/452
3,717,012 A * 2/1973 Misner ..... D04C 3/00 66/1 A
3,730,232 A * 5/1973 Kleiner ..... D03C 1/00 139/331
4,007,882 A * 2/1977 Isoard ..... B65H 67/04 242/473.7
4,019,540 A * 4/1977 Holman ..... D03D 41/004 139/20
4,080,915 A * 3/1978 Bompard ..... B29C 70/24 112/412
4,095,619 A * 6/1978 Kallmeyer ..... D03D 41/004 139/140
4,160,467 A * 7/1979 Woodruff ..... D03D 29/00 139/33
4,162,562 A * 7/1979 Beauregard ..... D03D 29/00 139/34
4,644,619 A * 2/1987 Cahuzac ..... D03D 41/004 28/100

(Continued)

OTHER PUBLICATIONS

European Search Report for European Application No. 21174832.2; Application Filing Date: May 19, 2021; dated Oct. 12, 2021; 9 pages.

*Primary Examiner* — Robert H Muromoto, Jr.
(74) *Attorney, Agent, or Firm* — Cantor Colburn LLP

(57) ABSTRACT

Disclosed is a weaving assembly including a rotatable base, a base positional controller, a weave control grid, a warp fiber support, warp fiber arms, a warp fiber arm positional controller and a fill fiber wand.

20 Claims, 4 Drawing Sheets

(56) References Cited

U.S. PATENT DOCUMENTS 4,656,703 A * 4/1987 Cahuzac ..... D03D 41/004 28/100
4,719,837 A 1/1988 McConnell et al.
4,846,229 A * 7/1989 Starlinger-Huemer ..... D03C 7/00 139/457
5,178,193 A * 1/1993 Sato ..... B65H 59/04 139/16
5,301,596 A 4/1994 Huey, Jr.
5,350,139 A * 9/1994 Leyderman ..... B28B 21/86 249/177
5,431,193 A * 7/1995 Mood ..... D03D 41/004 139/11
5,435,048 A * 7/1995 Walker ..... D03D 29/00 28/149
5,706,867 A 1/1998 Liao
5,794,885 A * 8/1998 Husek ..... D03D 49/20 139/304
7,658,210 B1 * 2/2010 Nyce ..... D03D 41/00 139/29
8,600,541 B2 12/2013 Shan et al.
8,655,475 B2 2/2014 Shan et al.
9,103,054 B2 8/2015 Shan et al.
9,409,356 B2 * 8/2016 Karb ..... B29C 70/382
9,725,833 B2 * 8/2017 Hasko ..... D03D 23/00
10,081,892 B2 * 9/2018 Kirkpatrick ..... B29B 11/16
10,239,235 B2 3/2019 Hollander
10,378,132 B2 8/2019 Jarrell et al.
10,870,200 B2 * 12/2020 Kayser ..... B25J 5/04
2001/0015510 A1 * 8/2001 Nakamura ..... B29C 31/002 264/159
2002/0032479 A1 * 3/2002 Hankh ..... D04C 1/06 623/1.16
2002/0160068 A1 * 10/2002 Nakamura ..... B29C 53/828 425/112
2003/0175453 A1 * 9/2003 Steffier ..... F02K 9/64 428/34.5
2006/0085960 A1 * 4/2006 O'Keefe ..... D04D 1/04 29/241
2011/0283871 A1 * 11/2011 Adams ..... A61F 2/90 87/9
2014/0014223 A1 * 1/2014 Hasko ..... D03D 23/00 139/35
2014/0110063 A1 * 4/2014 Mathon ..... B29C 53/562 156/446
2017/0362753 A1 * 12/2017 Le Costaouec ..... C04B 41/4554
2018/0057979 A1 * 3/2018 Kirkpatrick ..... D04H 1/43
2018/0223456 A1 8/2018 Mathon et al.
2019/0136425 A1 * 5/2019 Le Costaouec ..... C04B 41/4554

* cited by examiner

WEAVING ASSEMBLY AND METHOD OF USING

BACKGROUND

Exemplary embodiments of the present disclosure pertain to the art of robotic weaving of structures having varying contours.

Woven structures are known. Woven structures are made of multiple picks along the formation direction. In some traditional weaving techniques, the term "pick" describes one fill fiber that has been deposited and encapsulated by the entire array of warp fibers one row at a time. The term "pick" may apply to encapsulation of the fill fiber by one adjacent pair of warp fibers at a time.

Many components, such as ceramic matrix composite (CMC) or organic matrix composite (OMC) components used in a jet engine, use woven structures as preforms. The woven structure strengthens the component. During manufacturing of such components, the woven structure is placed in a mold as a precursor. A material is then injected into the remaining areas of the mold or deposited on the woven structure. The material surrounds the woven structure within the mold. If the mold has varying contours, manipulating woven assemblies, which are relatively planar, into a shape suitable for placing into the mold is difficult. Methods for forming three dimensional woven structures are desired.

BRIEF DESCRIPTION

Disclosed is a weaving assembly including a rotatable base, a base positional controller, a weave control grid, a warp fiber support, warp fiber arms, a warp fiber arm positional controller and a fill fiber wand.

In addition to one or more of the features described above, or as an alternative to any of the foregoing embodiments, the weave control grid is located on the rotatable base.

In addition to one or more of the features described above, or as an alternative to any of the foregoing embodiments, the rotatable base rotates relative to the fill fiber wand and warp fiber arms.

In addition to one or more of the features described above, or as an alternative to any of the foregoing embodiments, the warp fiber support rotates with the base.

In addition to one or more of the features described above, or as an alternative to any of the foregoing embodiments, the warp fiber support rotates independently of the base.

In addition to one or more of the features described above, or as an alternative to any of the foregoing embodiments, the warp fiber support includes movable segments.

In addition to one or more of the features described above, or as an alternative to any of the foregoing embodiments, the movable segments have differing shapes.

In addition to one or more of the features described above, or as an alternative to any of the foregoing embodiments, the warp fiber support includes notches.

In addition to one or more of the features described above, or as an alternative to any of the foregoing embodiments, the weaving assembly includes more than one warp fiber support. The warp fiber supports can be moved independently.

In addition to one or more of the features described above, or as an alternative to any of the foregoing embodiments, the weaving assembly includes a movable guide. The movable guide may include segments and the segments may be moved independently. Also disclosed is a weaving method including placing a first section of a fill fiber between warp fibers, forming a pick, rotating a base to reposition the warp fibers, and placing a second section of the fill fiber between the warp fibers to form a woven structure, wherein at least a portion of the warp fibers are introduced to the woven structure using a weave control grid and at least a portion of the warp fibers are in contact with at least a portion of a warp fiber support.

In addition to one or more of the features described above, or as an alternative to any of the foregoing embodiments, the warp fiber support rotates with the base.

In addition to one or more of the features described above, or as an alternative to any of the foregoing embodiments, the warp fiber support includes segments. The segments may be moved independently.

In addition to one or more of the features described above, or as an alternative to any of the foregoing embodiments, the warp fiber support has a contour in contact with the warp fibers and the contour relates to a final shape of a woven structure.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed assembly and method are presented herein by way of exemplification and not limitation with reference to the Figures.

Figure 1:
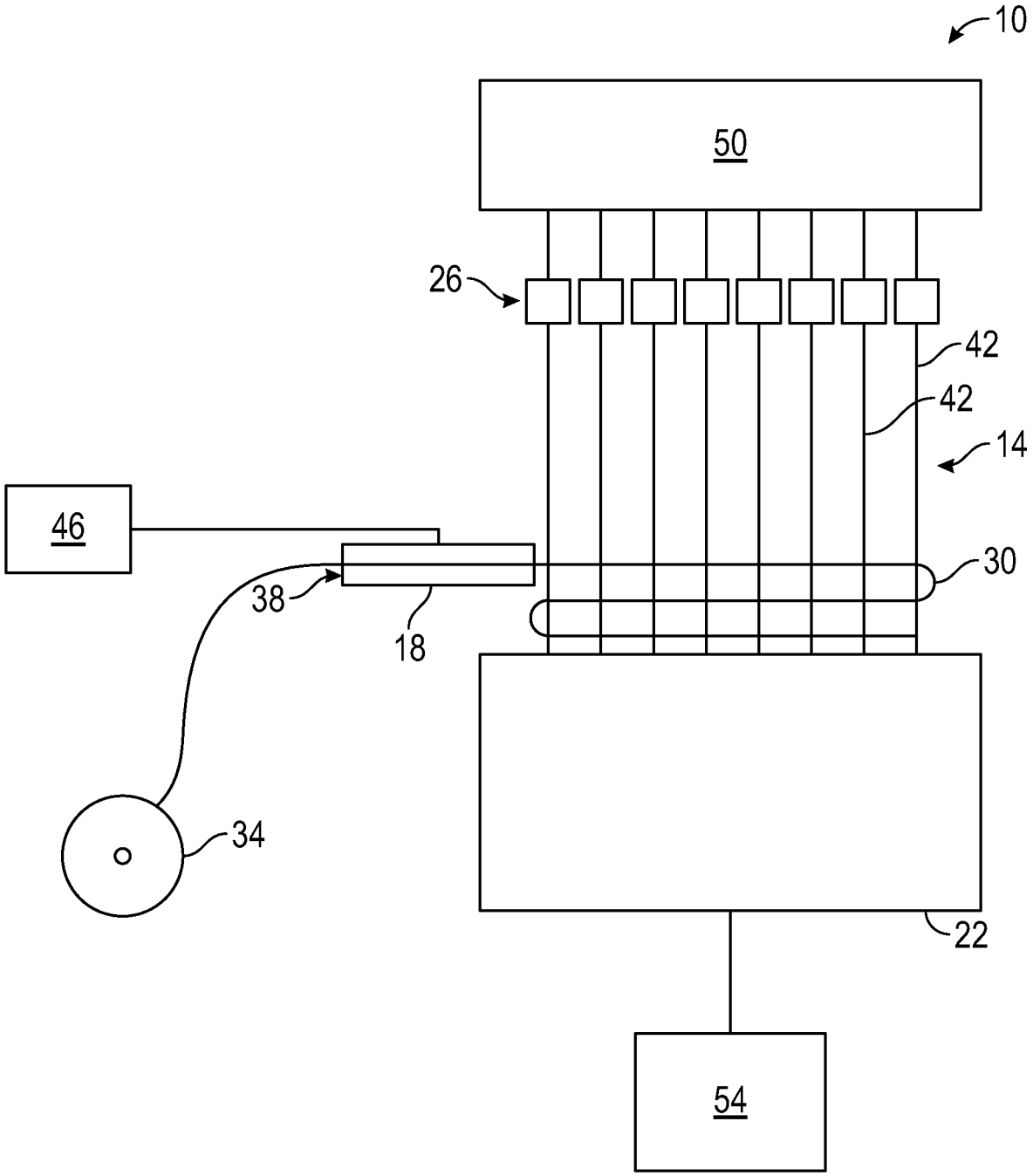
FIG. 1 shows a schematic view of an example weaving assembly.

Referring to FIG. 1, an example weaving assembly 10 is used to weave a woven structure 14. The weaving assembly 10 includes a wand 18, a weaving apparatus 22, and a plurality of warp fiber arms 26.

When weaving the woven structure 14, the wand 18 positions a fill fiber 30 between warp fibers 42. Controlled spacing of the warp fibers is important to consistent production of the woven structure. The fill fiber 30 extends from a spool 34 through a bore 38 in the wand 18. The wand 18, in this example, is a hollow tube. A fill fiber feed device may be included to meter the feed rate of the fill fiber with respect to the instantaneous relative velocity of the wand tip to the textile being created. The warp fibers 42 are manipulated by warp fiber arms 26.

The assembly 10 includes a positional controller 46 associated with the wand 18, a positional controller 50 associated with the warp fiber arms 26, and a positional controller 54 associated with the weaving apparatus 22. The positional controller 46 is able to move the wand 18 relative to the warp fiber arms 26 and the weaving apparatus 22. The positional controller 50 is able to move the warp fiber arms 26 relative to the wand 18 and the weaving apparatus 22. The positional controller 54 is able to move the weaving apparatus 22 relative to the wand 18 and the warp fiber arms 26. The positional controllers 46, 50, and 54 can be operated independently from each other or together.

Figure 2:
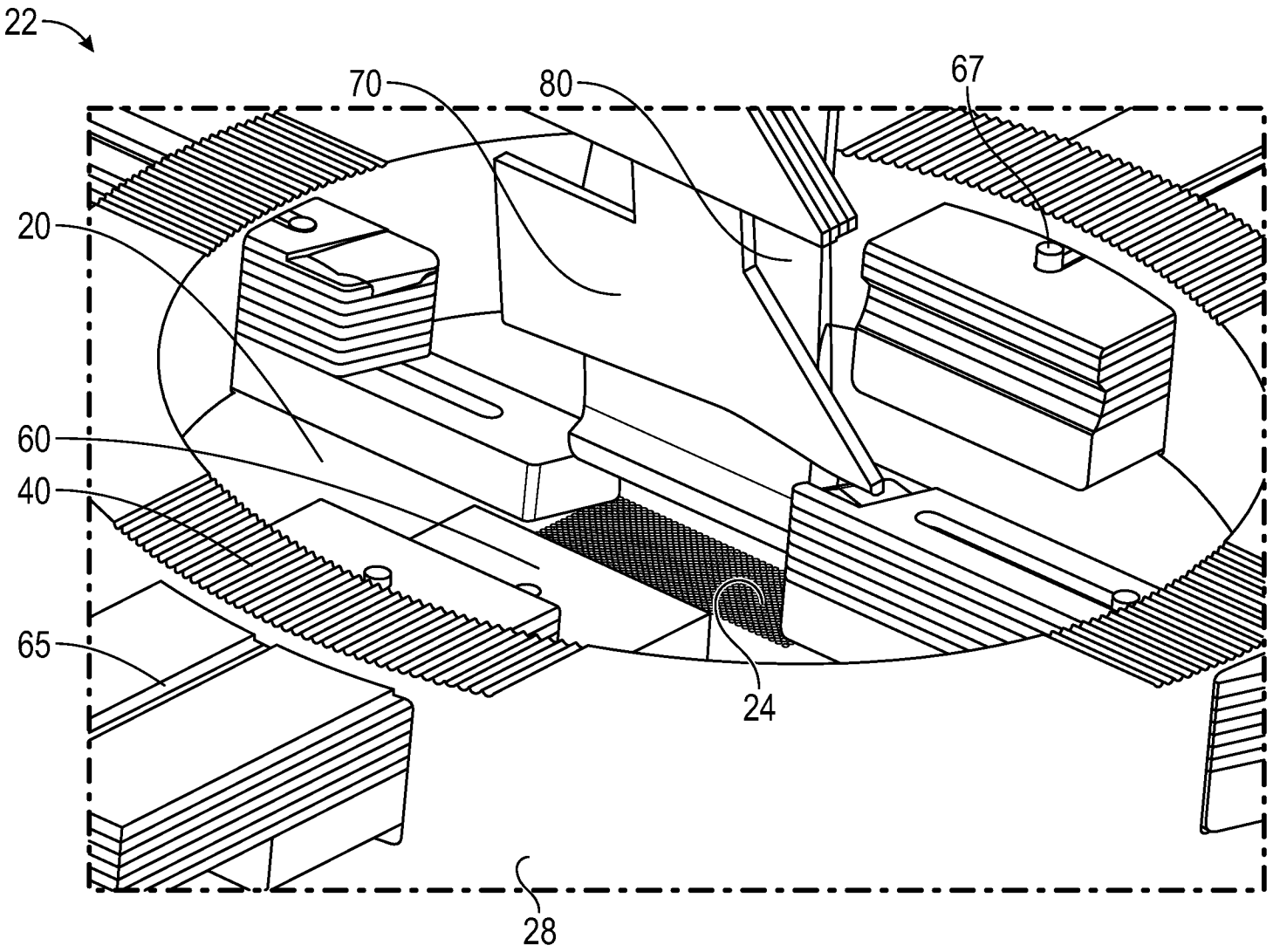
FIG. 2 shows an example weaving apparatus.

Referring to FIG. 2, the weaving apparatus 22 includes a base 20 and a weave control grid 24. Warp fibers 42 (not shown in FIG. 2) pass through the weave control grid 24.

The term "grid" as used herein describes a distribution pattern of openings with designated spacing. The desired spacing between grid openings may vary as needed to locate warp fibers in close proximity to the desired location for incorporation into weaving. The grid openings may be any shape or size that will permit the fibers to pass through. The lower end of the warp fibers may be secured to the base below the weave control grid or may be secured to a separate structure below the base. The upper end of the warp fibers are manipulated as needed by the warp fiber arms to form the desired weave. The upper end may be encased in or attached to an end fitting (not shown) to facilitate manipulation. The end fitting may be magnetic. In some embodiments the warp fiber end fittings may be located in grooves 40 when the warp fibers are not being manipulated by the warp fiber arms.

The base 20 in FIG. 1 is round but may take any shape such as square, rectangular, octagonal, hexagonal and the like. A rim 28 is located adjacent to the base 20. The base 20 may be attached to rim 28 or rim 28 and base 20 may be capable of moving independently. Positional controller 54 is able to move the base 20, rim 28 or both. Warp fiber support 60 passes through openings in rim 28. Warp fiber support 60 may be a single piece or segmented as shown in FIG. 2 and the segments may move (be actuated) independently. The segments may have a slot 65 with a pin 67 to prevent the segments from being removed from the rim 28. When more than one warp fiber support is present the warp fiber supports may move (be actuated) independently. The ability to move the warp fiber supports and segments independently facilitates manipulation of the stroke distance from the work piece and control of the compaction of the weave in process.

While FIG. 2 shows four segmented warp fiber supports it is contemplated that any number of warp fiber supports may be employed. Furthermore, the spacing, shape and orientation of the warp fiber supports may be designed to provide sufficient support to specifically and accurately locate the warp fibers during weaving. In some embodiments the segments of the warp fiber supports may have different shapes in order to more closely reflect the desired final shape of the woven article. In some embodiments the warp fiber supports include notches for placement of the warp fibers during weaving to minimize translational motion and more accurately locate the warp fibers. The warp fiber supports allow the warp fibers to be accurately, precisely and consistently located, particularly during the formation of a bend or curve in the woven structure as it is recognized that during three-dimensional weaving vertical tension may be insufficient to accurately maintain warp fiber location.

The weaving apparatus 22 may optionally include a movable guide 70. Movable guide 70 is oriented at an angle greater than 90 degrees and less than or equal to 180 degrees relative to the base 20. Similar to the warp fiber support 60 movable guide 70 may have segments which enable the movable guide to change the shape in contact with the warp fibers as needed to support and locate the warp fibers. The movable guide 70 location may be managed by positional controller 54 or a separate positional controller. Also shown in FIG. 2 is a component 80 which can function as a mandrel which the woven structure is formed around. It is further contemplated that component 80 may be the core of the final woven article. Alternatively, in some embodiments the component 80 is removed and does not form part of the final woven article.

Figure 3:
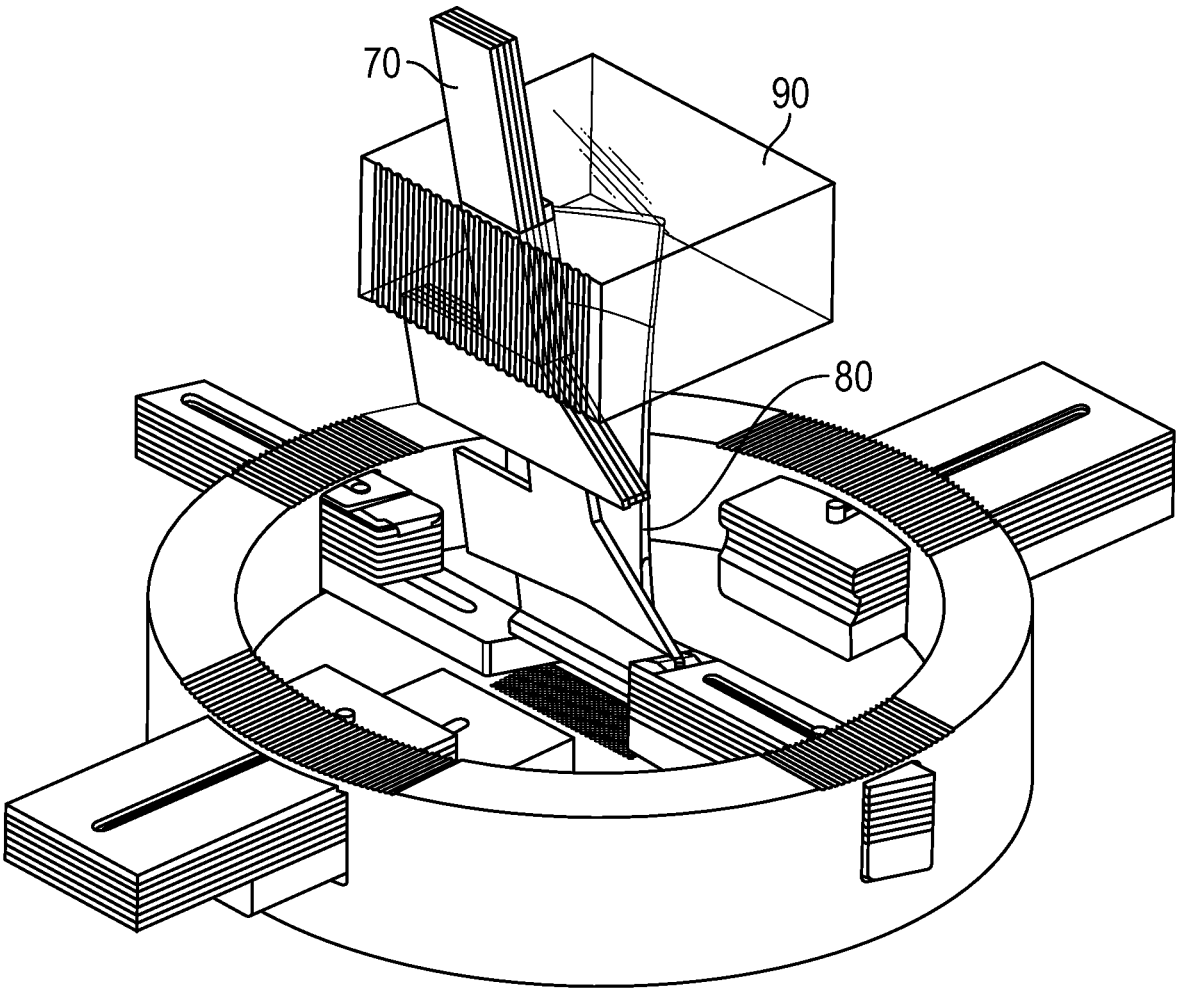
FIG. 3 shows an example weaving apparatus.

Component 80 may be held in place by component constraint 90 as shown in FIG. 3. Movable guide 70 may also be supported by component constraint 90.

The supports and movable guides (when present) can be made from many different materials. Supports may be made from a hard or hardenable material such as cast iron, or a metal substrate with a hardface applied, such as "Stellite", to reduce wear caused by the fiber. Alternatively, the supports may have a slippery surface like a polytetrafluoroethylene coating or surfaces made from plastic, such as polyamide, to minimize friction or snagging of the individual filament within the fiber. Additionally, the supports, movable guides and/or overall system made be made from high-temperature materials such a graphite, silicon carbide, silicon nitride or an oxide material such as aluminum oxide.

The materials used for the supports may be different for each support and/or segment, based upon the dynamics of the fiber manipulation. Simple segments may be made from inexpensive steel or plastic. Supports which are used to change the fundamental direction and compaction of the fibers may be made from a material better suited to the loads and motions of the fibers.

Figure 4:
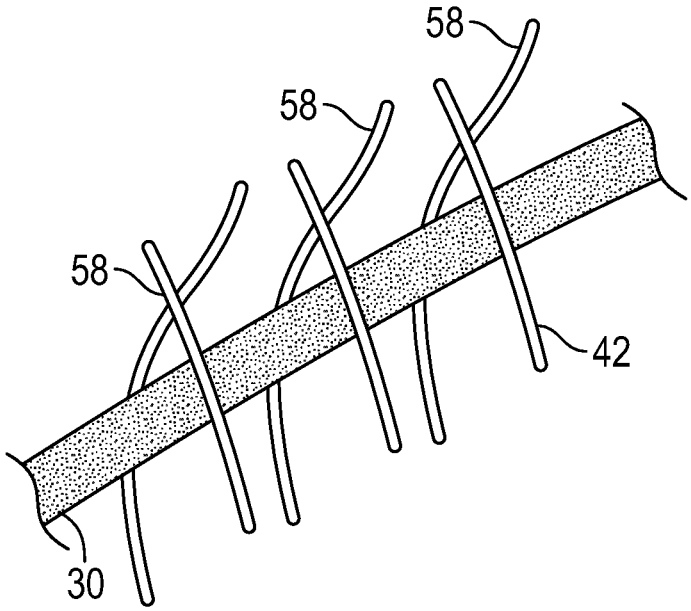
FIG. 4 shows a view of several picks.
Figure 5:
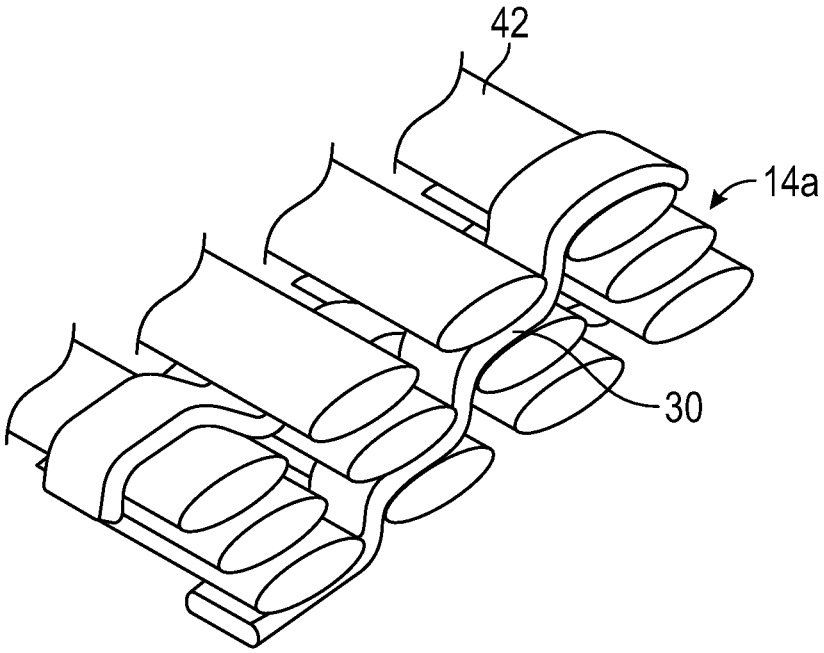
FIG. 5 shows a close-up view of a woven structure having multiple layers.

Referring to FIGS. 4-5 with continuing reference to FIGS. 1-3, the woven structure 14 includes multiple picks 58. In this example, warp fibers 42 are crossed over multiple sections of the fill fiber 30 to form picks 58. The warp fiber arms are actuated to cross the warp fibers 42 over the fill fiber 30, which entraps the fill fiber to form the pick 58.

Exemplary fiber materials include glass, graphite, polyethylene, aramid, ceramic, boron and combinations thereof. One of the fill fibers 30 or warp fibers 42 may include hundreds or thousands of individual filaments. In some embodiments the fill fibers include 500 to 800 filaments. Fibers are also sometimes referred to as "tows". The individual filaments may have diameters that range from 5 to 25 microns, although boron filaments may be up to 142 microns in diameter.

Each of the warp fiber arms may hold one or several of the warp fibers 42. After crossing the warp fibers 42 over the fill fiber 30, the warp fiber arms hand-off the warp fiber 42 to another of the warp fiber arms or places it in groove 40. The "hand-off" feature allows an open shed so that the warp fiber arms do not interfere with the wand 18. After the hand-off, the warp fiber arms are then crossed over another section of the fill fiber 30 to form another pick 58.

The warp fiber arms engage portions of the warp fibers 42. These portions may include end fittings. The warp fiber arms grab the end fittings holding the warp fibers 42. The end fittings may be placed in groove 40 to help maintain the position of the warp fibers 42 during weaving.

A person having skill in this art and the benefit of this disclosure would understand how to create picks by crossing warp fibers over a fill fiber, and how to hand-off a warp fiber from one warp fiber arm to another warp fiber arm.

When weaving, the wand 18 moves the fill fiber 30 past the warp fibers 42. The wand 18 moves the fill fiber 30 in a spiral to create built-up layers of picks 58 as the base rotates. The rim may move with the base or separately. The wand 18 may be long enough to reach down through the longest warp fibers 42 during the weaving.

Elements of the weaving apparatus 22 are moved as dictated by the design of the woven structure 14 to create the shape of the woven structure 14. Elements of the weaving apparatus 22 are thus capable of movement relative to the warp fiber arms 26.

For example, the base 20 rotates so that the pick formation point is at a position relative to the wand 18, and the fill fiber 30, and the warp fiber support is moved to provide support to the warp fibers as they are manipulated to form bends and curves. Segments in the warp fiber support facilitate the development of three-dimensional shapes.

The path and manipulations of the weaving apparatus 22 with the positional controller 54, the number of warp fibers 42 engaged by the warp fiber arms 26 when forming each pick, and the sequence of warp fiber arm movements may be designed and pre-planned in a software model to produce the woven structure 14 having the desired contours. A stable shape is obtained by the interplay of fiber forces and friction within the textile unit cells throughout the component.

The software model may utilize as inputs: a CAD definition of the surfaces of a desired component incorporating the woven structure; a definition of the initial warp fibers' lengths, locations, and orientations; and a definition of a textile repeating unit cell (or pick). The software calculates motions of the wand 18, weaving apparatus 22, and warp fiber arms 26 necessary to achieve desired contours in the woven structure 14, without colliding into each other. The software model is then used as input for the positional controllers 46, 50, 54, and control of the fill fiber wand.

Referring to FIG. 5, in some examples a woven structure 14*a* may include multiple layers of the warp fibers 42. The fill fiber 30 joins all three layers in this example. When weaving the woven structure 14 the warp fiber arms may selectively engage one, two, or more warp fibers.

When weaving is complete the woven structure may be removed from the assembly and may be subjected to further processing such as consolidation or matrix deposition. In some embodiments the woven structure may be separated from a portion of the weaving assembly while leaving portions of the weaving assembly in contact with the woven structure during subsequent processing. When portions of the weaving assembly are left in contact with the woven structure during further processing the materials used to form these portions are chosen to withstand the processing conditions.

Features of the disclosed method and assembly include a relatively precise and repeatable mechanized process that is conducive to high volume production of complex shape components such as turbine engine components with precise and repeatable introduction of warp fibers as the woven structure evolves. Locating the warp fibers in close proximity to the desired position for incorporation into weaving and with controlled spacing results in a more consistent and precise woven structure with better reproducibility of physical characteristics between woven structures.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A weaving assembly comprising:

a weaving apparatus that includes a rotatable base and a weave control grid, a base positional controller that moves the weaving apparatus, a warp fiber support that locates warp fibers, warp fiber arms that manipulate warp fibers, the warp fibers passing through the weave control grid, a warp fiber arm positional controller that moves the warp fiber arms relative to a fill fiber wand, and wherein the fill fiber wand positions a fill fiber between warp fibers;

wherein the warp fiber support comprises movable segments, the movable segments of the warp fiber support passing through an opening in a rim; and wherein the movable segments have a slot with a pin to prevent the movable segments from being removed from the rim.

2. The weaving assembly of claim 1, wherein the weave control grid is located on the rotatable base; and wherein the weave control grid includes a distribution pattern of openings with designated spacing, and a desired spacing between grid openings varies as needed to locate warp fibers in close proximity to desired locations for incorporation into weaving.

3. The weaving assembly of claim 1, wherein the rotatable base rotates relative to the fill fiber wand and warp fiber arms.

4. The weaving assembly of claim 1, wherein the warp fiber support rotates with the base.

5. The weaving assembly of claim 1, wherein the warp fiber support rotates independently of the base.

6. The weaving assembly of claim 1, wherein the rim is located adjacent to the rotatable base.

7. The weaving assembly of claim 1, wherein the movable segments have differing shapes.

8. The weaving assembly of claim 1, wherein the movable segments can be moved independently of each other.

9. The weaving assembly of claim 1, wherein the warp fiber support comprises notches.

10. The weaving assembly of claim 1, comprising more than one warp fiber support.

11. The weaving assembly of claim 10, wherein the warp fiber supports are moved independently.

12. The weaving assembly of claim 1, further comprising a movable guide.

13. The weaving assembly of claim 12, wherein the movable guide comprises segments.

14. The weaving assembly of claim 13, wherein the movable guide segments are moved independently.

15. A weaving method comprising:

providing a weaving apparatus that includes a rotatable base and a weave control grid, and warp fiber arms that manipulate warp fibers, the warp fibers passing through the weave control grid;

placing a first section of a fill fiber between warp fibers, forming a pick, rotating a base to reposition the warp fibers, and placing a second section of the fill fiber between warp fibers to form a woven structure, wherein at least a portion of the warp fibers are introduced to the woven structure using the weave control grid and at least a portion of the warp fibers are in contact with at least a portion of a warp fiber support;

wherein the warp fiber support comprises movable segments, the movable segments of the warp fiber support passing through an opening in a rim; and wherein the movable segments have a slot with a pin to prevent the movable segments from being removed from the rim.

16. The weaving method of claim 15, wherein the warp fiber support rotates with the base.

17. The weaving method of claim 15, wherein the rim is located adjacent to the base.

18. The weaving method of claim 15, wherein the segments are moved independently.

19. The weaving method of claim 15, wherein the warp fiber support has a contour in contact with the warp fibers and the contour relates to a final shape of the woven structure.

20. The weaving method of claim 15, wherein the weave control grid includes a distribution pattern of openings with designated spacing, and a desired spacing between grid openings varies as needed to locate warp fibers in close proximity to desired locations for incorporation into weaving.

* * * * *